US006585349B1

(12) United States Patent
Lou et al.

(10) Patent No.: US 6,585,349 B1
(45) Date of Patent: Jul. 1, 2003

(54) AUTOMATED REMOVAL OF DEPOSITS ON OPTICAL COMPONENTS IN PRINTERS

(75) Inventors: Damon Howard Lou, San Diego, CA (US); Arthur K Wilson, San Diego, CA (US); Mark Alan McCluskey, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/703,318

(22) Filed: Oct. 31, 2000

(51) Int. Cl.[7] ..... B41J 2/165
(52) U.S. Cl. ..... 347/33
(58) Field of Search ..... 347/33, 19, 23, 347/102, 37; 355/30, 405; 399/302, 343; 359/507; 346/25

(56) References Cited

U.S. PATENT DOCUMENTS

| | | | | |
|---|---|---|---|---|
| 4,074,217 A | | 2/1978 | Yanagawa | 355/30 |
| 4,358,952 A | | 11/1982 | Maurer et al. | 73/35.07 |
| 4,991,949 A | | 2/1991 | Moorehead | 359/507 |
| 5,255,009 A | * | 10/1993 | Bauer et al. | 347/25 |
| 5,420,674 A | * | 5/1995 | Kobayashi | 355/256 |
| 6,050,672 A | * | 4/2000 | Matsuhashi | 347/36 |

FOREIGN PATENT DOCUMENTS

| | | | | |
|---|---|---|---|---|
| GB | 2 142 579 A | * | 1/1985 | |
| JP | 406238906 A | * | 8/1994 | 347/33 |

* cited by examiner

*Primary Examiner*—Shih-Wen Hsieh

(57) ABSTRACT

A cleaning system and method for an optical apparatus of a printer. A heating apparatus and a cleaning apparatus are provided in the printer to dry deposits on an optical surface of the optical apparatus and to remove them through mechanical engagement. In an inkjet printer, these deposits are typically stray aerosol ink droplets. In some embodiments the optical apparatus is movable, while the cleaning apparatus is fixed; in other embodiments the cleaning apparatus is movable, while the optical apparatus is fixed; in still other embodiments both apparatuses are movable. The cleaning apparatus typically includes a wiper, brush, scraper, or pad. The optical apparatus typically includes one or more optical elements such as a light source, a light sensor, and a lens. The heating apparatus, which may be operated intermittantly or continuously, may be an heat or light source external to the optical apparatus and positionable in thermal proximity to it for drying the deposits; alternatively, the heating apparatus may be on or within the optical apparatus, or internal to one of the optical elements.

45 Claims, 18 Drawing Sheets

AUTOMATED REMOVAL OF DEPOSITS ON OPTICAL COMPONENTS IN PRINTERS

FIELD OF THE INVENTION

The present invention relates generally to computer printers, and pertains more particularly to the cleaning of optical components used in these printers.

BACKGROUND OF THE INVENTION

Inkjet printers, and thermal inkjet printers in particular, have come into widespread use in businesses and homes because of their low cost, high print quality, and color printing capability. These printers and related hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference.

The operation of such printers is relatively straightforward. In this regard, droplets of a colored ink are emitted onto a print medium such as paper, transparency film, textiles, and the like during a printing operation, in response to commands electronically transmitted to a printhead. These drops of ink, which are typically dye-based or pigment-based, combine on the print medium to form a pattern of spots that make up the text and images perceived by the human eye. Inkjet printers may use a number of different ink colors. One or more printheads are mounted in a print cartridge, which may either contain the supply of ink for each printhead or be connected to an ink supply located off-cartridge for the printhead. An inkjet printer frequently can accommodate two to four such print cartridges. The cartridges are typically mounted side-by-side in a carriage which, during printing, scans the cartridges back and forth above the medium, and the ink droplets are controllably ejected, at the proper times and at the proper locations of the print cartridges relative to the print medium, so as to form the printed text and images on the print medium.

Many such printers incorporate optical components within the printer housing. These components are used for many purposes, including detecting the position of the carriage within the printer, detecting the motion and position of the print medium in the printer, determining the type of print medium, determining the alignment of print cartridges in the carriage, and evaluating the quality of printed text and images on the medium. The optical components may include a light source, a light sensor, a lens assembly, or a combination of these.

During printer operation, and over time, the performance of these optical components may degrade due to the buildup of deposits on their surface. Aerosol droplets of ink intended for the print medium may instead be misdirected or carried by air currents within the printer onto the surface of optical components instead, the droplet deposits reducing the transmission of light to, from, or through the components. Other unwanted deposits, such as dust from paper print media, or debris from the external environment including dead skin, insect droppings, animal hair, carpet dirt and the like, may similarly collect on the optical components and degrade their performance. The performance degradation generally results from the deposits reducing the amount of light which can be sourced, sensed, or transmitted. Such deposits are generally not removable from the optical components by the user, and the preferred repair strategy of the printer manufacturer typically is to replace the optical component or a higher-level assembly rather than to clean the optical component.

Some printers have attempted to avoid or reduce deposits by moving the optical components away from the print medium, provide shielding around the optical components to block stray droplets, or create airflow to carry stray droplets away from optical components. However, in many cases the optical components must be located near, and with an optically unobstructed view of, the print medium in order to perform its function, and airflow management schemes are often unreliable.

Accordingly, it would be highly desirable to have a new and improved way to clean performance-degrading deposits from optical components effectively and reliably.

SUMMARY OF THE INVENTION

In a preferred embodiment, the present invention provides a cleaning system for optical components in a printer that effectively and reliably removes unwanted deposits from the surface of the components so as to automatically maintain proper operation of the printer and a high quality of printed output without requiring action by the user. By locating the cleaning system within the printer in a position which takes advantage of existing movable parts, such as the carriage of a scanning inkjet printer, the cleaning operation can be performed in a simple and cost-effective manner without requiring complex movable parts or drive components.

The cleaning system includes an optical apparatus mounted in the printer, with an optical surface on which the unwanted deposits can collect during printer operation. The optical apparatus may include one or more optical elements such as a light source (for example, a light-emitting diode or LED), an optical sensor (for example, a photocell), and a light-transmissive element (for example, a lens). Also mounted in the printer in a manner that allows for relative movement with respect to the optical apparatus is a cleaning apparatus. The cleaning apparatus is mechanically engageable with the optical apparatus during a cleaning operation of the printer so as to remove the deposits from the optical surface of the optical apparatus. The cleaning apparatus may include a scraper, a wiper, a brush, or a cleaning pad.

In inkjet printers, stray aerosol ink drops are a common source of undesirable deposits on the optical surfaces. The cleaning system preferably includes a heating apparatus for drying the deposits prior to the removing. The heating apparatus may be of any type, including a heat source and a light source. The heating apparatus is either fixed in a position, or intermittently positionable in a position, which puts it in thermal proximity to the optical apparatus so as to direct sufficient amounts of heat onto the optical surface in order to dry any wet or moist deposits. The heating apparatus may be either a source external to the optical apparatus. The heating apparatus may also be a heating element, such as a resistor or heater coil, incorporated on a surface of or within the body of the optical apparatus. In some embodiments the heating element may be fabricated into one of the optical elements, such as an LED. Such a heating element may be responsive to a separate heater control signal supplied to the optical apparatus, or to a higher-than-normal operating signal, from a print controller or other signal source in the printer. Within the printer, at least one of the optical and cleaning apparatuses is movable mounted. In an inkjet printer with a carriage that reciprocally scans from one side of the printer to the other, the movable apparatus is preferentially attached to the carriage, while the other apparatus is mounted in a stationary position to the printer frame. In such a configuration, the heating apparatus can be mounted with either the cleaning apparatus or the optical apparatus, and to either the carriage or the frame.

The present invention may also be implemented as a method for removing unwanted deposits from an optical surface of an optical apparatus in a printer. Such a method provides a cleaning apparatus within the printer for relative motion with respect to the optical apparatus. During operation, the cleaning apparatus is engaged with the surface of the optical apparatus, and the deposits are removed from the surface during the engaging. The engaging involves moving a movable cleaning apparatus into engagement with a stationary apparatus moving a movable optical apparatus into engagement with a stationary cleaning apparatus, or moving both a movable optical apparatus and a movable cleaning apparatus into engagement with each other. The removing includes scraping, wiping, or brushing the deposits from the surface of the optical apparatus with the cleaning apparatus. The method also involves heating the surface of the optical apparatus in order to eliminate any wetness or moisture from the deposits. The heating may be performed intermittently during a cleaning operation of the printer, or continuously during printing operations of the printer. The heating apparatus is also positioned in thermal proximity to the optical apparatus; it may be either stationarily mounted or intermittently positioned in such a proximity. Where the heating apparatus is stationarily mounted in proximity, it may also be fabricating as part of the optical apparatus assembly or as part of an optical element included in the optical apparatus. In some embodiments where the heating apparatus is part of an optical element, the heating includes applying a different-than-normal operating signal to the optical element in order to produce the heating.

BRIEF DESCRIPTION OF THE DRAWINGS

The above-mentioned features of the present invention and the manner of attaining them, and the invention itself, will be best understood by reference to the following detailed description of the preferred embodiment of the invention, taken in conjunction with the accompanying drawings, wherein:

FIG. 6A illustrates a starting position where the cleaning apparatus is not engaged with the optical apparatus; FIG. 6B illustrates an intermediate position where the optical apparatus is moved along a first axis to the proper position for engagement with the cleaning apparatus; and FIG. 6C illustrates an initial engagement position where the cleaning apparatus is moved along a second axis into engagement with the optical apparatus;

FIG. 13A illustrates a starting position where neither the heating apparatus nor the cleaning apparatus are engaged with the optical apparatus; FIG. 13B illustrates a heating position where the heating apparatus is positioned in thermal communication with the optical apparatus so as to dry deposits on the optical surface; FIG. 13C illustrates an initial engagement position where the cleaning apparatus is just entering into engagement with the optical apparatus to removed the deposits from the optical surface; and FIG. 13D illustrates a final engagement position where the cleaning apparatus is just ending engagement with the optical apparatus after having removed the deposits from the optical surface.

DESCRIPTION OF THE PREFERRED EMBODIMENT

Figure 1:
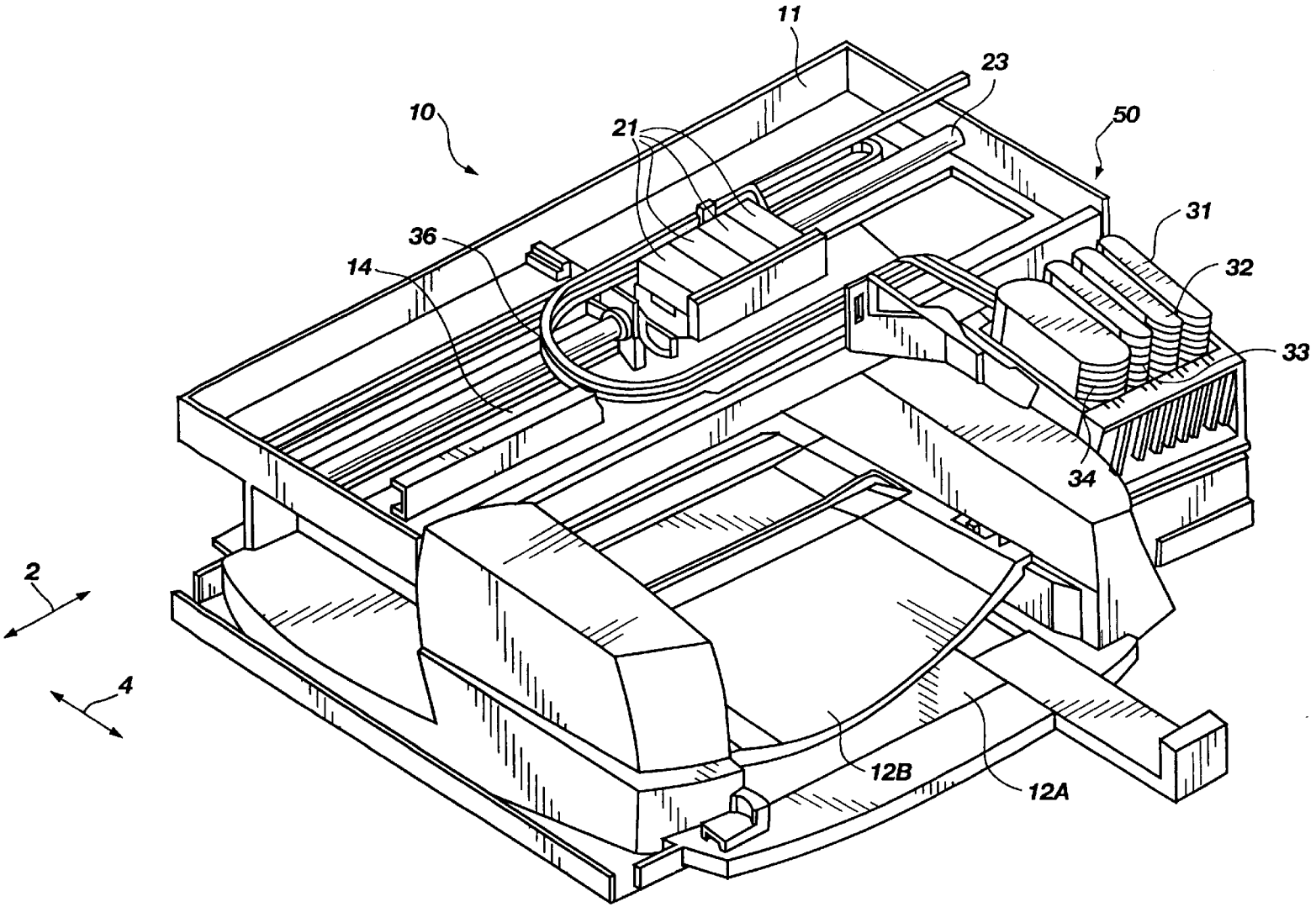
FIG. 1 is an isometric view of a printer embodying the present invention.

Referring now to the drawings, there is illustrated a cleaning system for a printer constructed in accordance with the present invention which automatically removes deposits from optical components used into the printer. Removing these undesirable deposits ensures that the optical components operate at an acceptable level of optical performance, avoiding the performance degradation and subsequent repair expenses and downtime that such deposits can otherwise cause.

Figure 2:
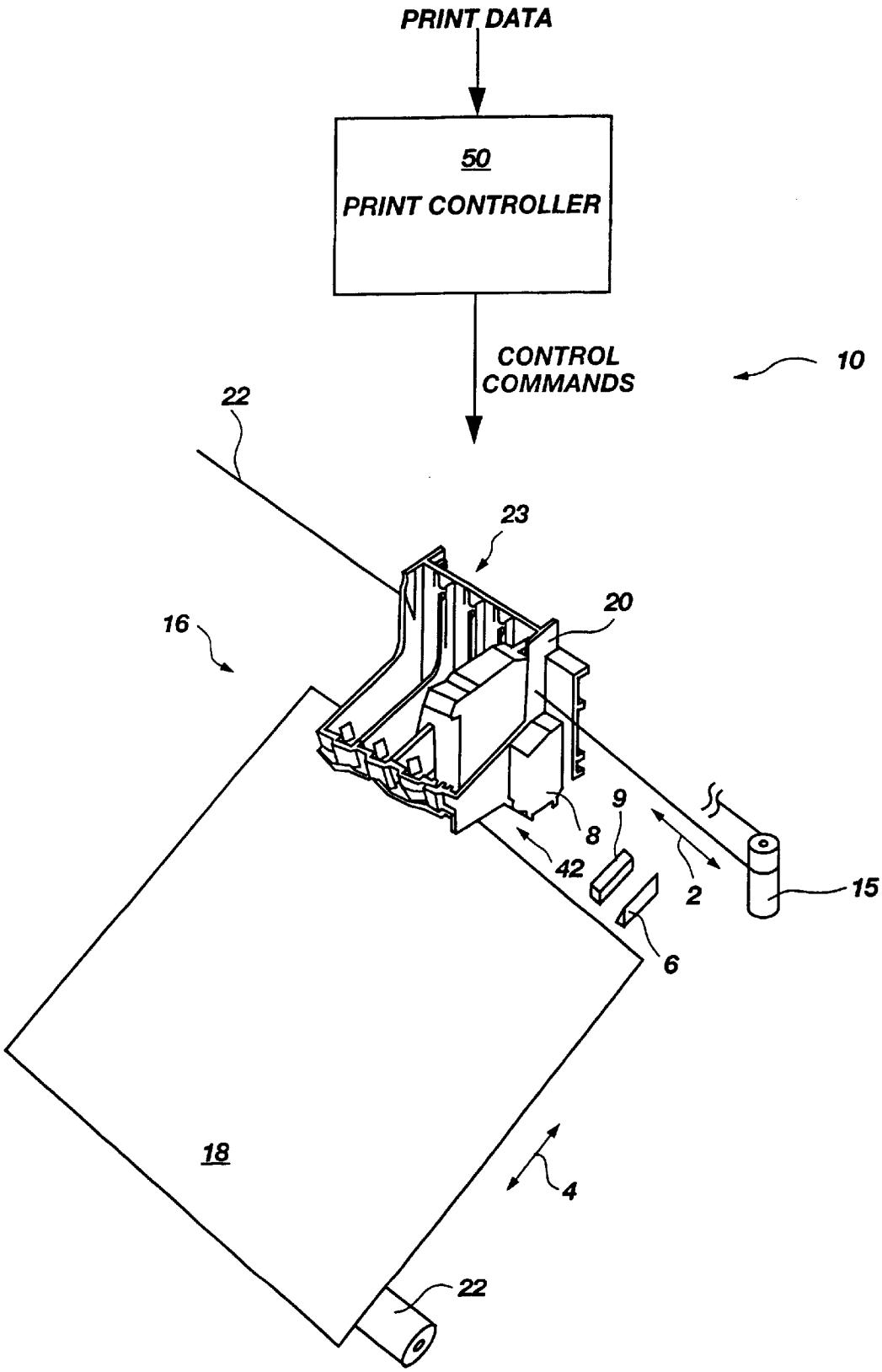
FIG. 2 is a schematic representation of the carriage, optical apparatus, heating apparatus, and cleaning apparatus according to the present invention of one embodiment of the printer of FIG. 1.

As best understood with reference to FIGS. 1 and 2, a presently preferred embodiment of a printer 10 containing the cleaning system includes an optical apparatus 8 disposed in the printer 10, and a cleaning apparatus 6 which is mechanically engageable with the optical apparatus 8 during a cleaning operation for removing the deposits from a surface 42 of the optical apparatus 8. The presently preferred embodiment also includes a heating apparatus 9 for drying deposits which have a moistness, such as stray aerosol ink drops, prior to the removing.

Figure 9:
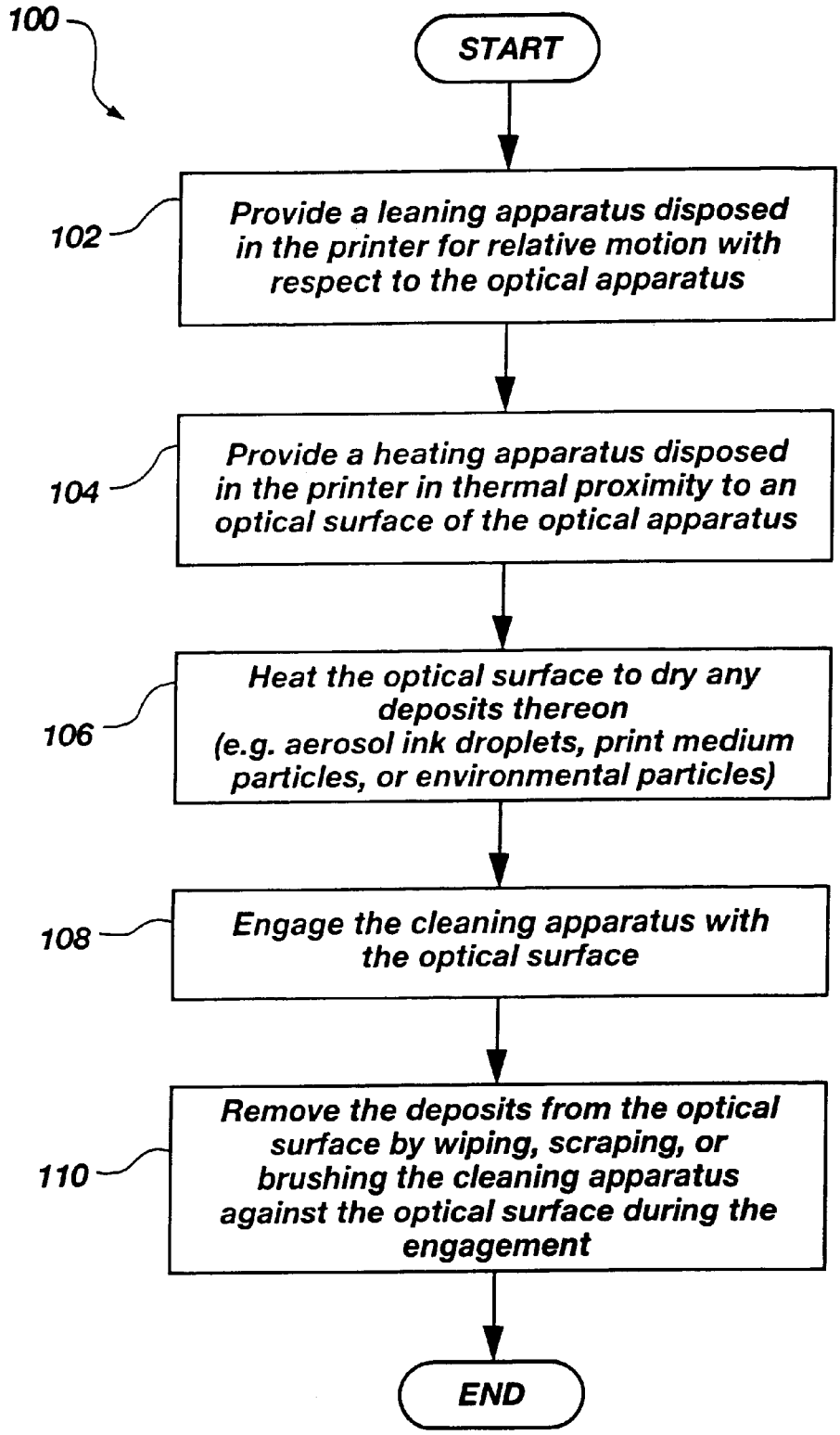
FIG. 9 is a flowchart of a method for removing deposits from an optical surface of the optical apparatus of the printer of FIG. 1.

In the cleaning operation, and in accordance with a novel method of the present invention for removing deposits from an optical apparatus 8 as best understood with reference to FIG. 9, a cleaning apparatus 6 disposed in the printer 10 for relative motion with respect to the optical apparatus 8 is provided. The cleaning apparatus 6 is engaged with a surface of the optical apparatus 8, and the deposits are removed from the surface of the optical apparatus 8 during the engaging. In a presently preferred embodiment of the cleaning method for removing deposits which have a moistness, the method includes heating the surface of the optical apparatus 8 to eliminate the moistness from the deposits. The heating preferentially is performed prior to or during the engaging.

Considering now a preferred embodiment of the printer 10 in further detail, and with continued reference to FIGS. 1 and 2, the printer 10 includes a frame 11, an input tray 12*a* in which a supply of the media to be printed are stacked prior to printing, and an output tray 12*b* where the media are placed after printing is complete. Each medium 18 is fed into the printer and positioned adjacent the carriage 20 for printing. The print medium 18 has a plurality of pixel locations organized in a rectangular array of rows (along the medium advance axis 4) and columns (along the scan axis 2) on the medium 18. Each print cartridge 21 is installed in the carriage 20 such that the nozzles (not shown) through which the droplets of ink (or another fluid) are emitted are facing in a preferably downward direction so as to eject the ink or fluid onto the surface of the medium 18. Since ink is the preferred fluid, the invention will hereinafter be described with reference to ink, though it is understood that the fluid of the present invention is not limited to ink. Ink can be supplied to the printhead 79 in a number of different ways, including from a reservoir which is self-contained in the print cartridge 21, or via a tube 36 from an off-carriage reservoir or vessel, such as one of reservoirs 31,32,33,34. Different print cartridges 21 (four of which are illustrated in FIG. 1) typically contain different color inks, such as magenta, yellow, cyan, and black inks, drops of which can be combined to form a variety of colored dots on the medium 18. The printer 10 also contains a print controller, generally indicated at 50, which receives the data to be printed on the medium 18 from a data source such as a computer (not shown) connected to the printer 10, and determines how and when to print corresponding dots on the medium 18. As is known to those skilled in the art, the controller 50 orchestrates the printing by issuing carriage scan control commands to the scan drive mechanism 15 which moves the carriage 20 along the slider bar 23 relative to the medium 18 in the scan direction 2, by issuing medium advance control commands to the medium drive mechanism 22 which moves the medium 18 relative to the carriage 20 in the medium advance direction 4, and by issuing ink emission control commands to the appropriate print cartridge 21 to eject the droplets of fluid from the nozzles onto the medium 18.

Figure 3:
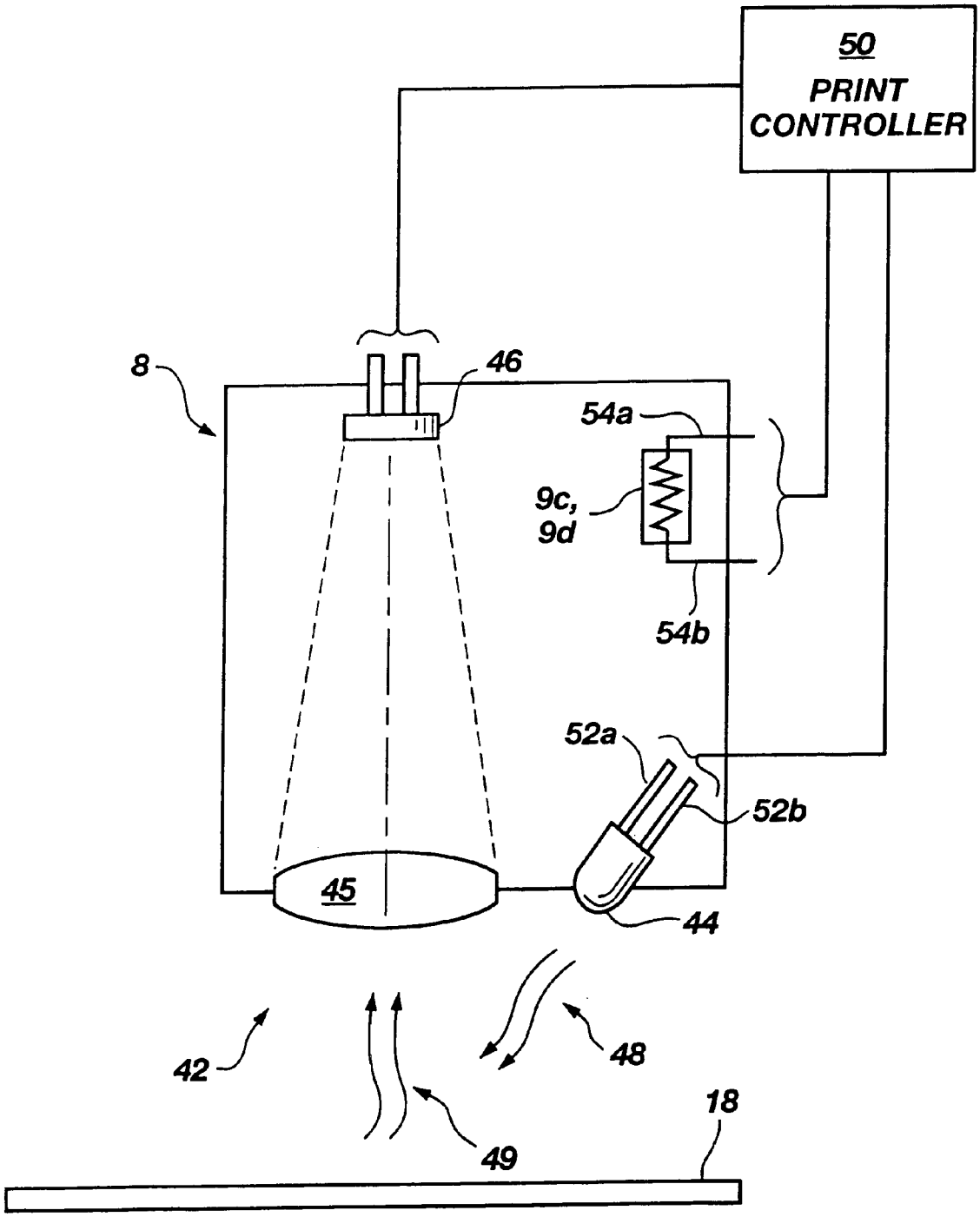
FIG. 3 is a more detailed schematic representation of the optical apparatus of FIG. 2.

Considering now the optical apparatus 8 in further detail, and with reference to FIG. 3, the optical apparatus 8 may include one or more optical elements which provide, or are incorporated into, an optical surface 42. These optical elements generally include a light source 44, an optical sensor 46, and a light-transmissive element 45. The light source 44 may generate a narrow or broad set of frequencies of light. The light source 44 preferentially is a light-emitting diode (LED) 44*a*, but other types of light sources including incandescent, fluorescent, infrared, and the like are usable with the present invention. The light-transmissive element 45 may be a transparent or translucent material which allows light (such as received light 49) to pass through with a predetermined amount of light scattering. The light-transmissive element 45 may alternatively be a lens which collects and focuses light rays 49, or the like. The optical sensor 46 is a light-Patent sensing element such as a photodiode or a phototransistor, which may be packaged with or without the associated electronics required to implement a light-to-voltage converter. The optical sensor may be designed to sense visible light, infrared light, or ultraviolet light, and may be optimized to detect a particular frequency, or range of frequencies, of that type of light. Frequently the optical apparatus 8 includes more than one type of optical element, or more than one element of any particular type, as required to perform the particular optical function of the apparatus 8. As known to those skilled in the art, such functions include, but are not limited to, detecting the location of the carriage 20 within the printer 10; detecting the motion and position of the print medium 18 in the printer 10; determining the type of print medium; determining the alignment of print cartridges 21 in the carriage 20; and evaluating the quality of printed text and images on the medium 18. The light source 44 and the optical sensor 46 are electrically connected to the print controller 50. The print controller 50 switches the light source 44 on and off as required to generate light 48, and controls the intensity of the light emitted therefrom. The controller 50 also captures the electrical signals produced by the optical sensor 46, these signals typically correspond to one or more characteristics, such as intensity and frequency, of the received light 49.

Figure 4A:
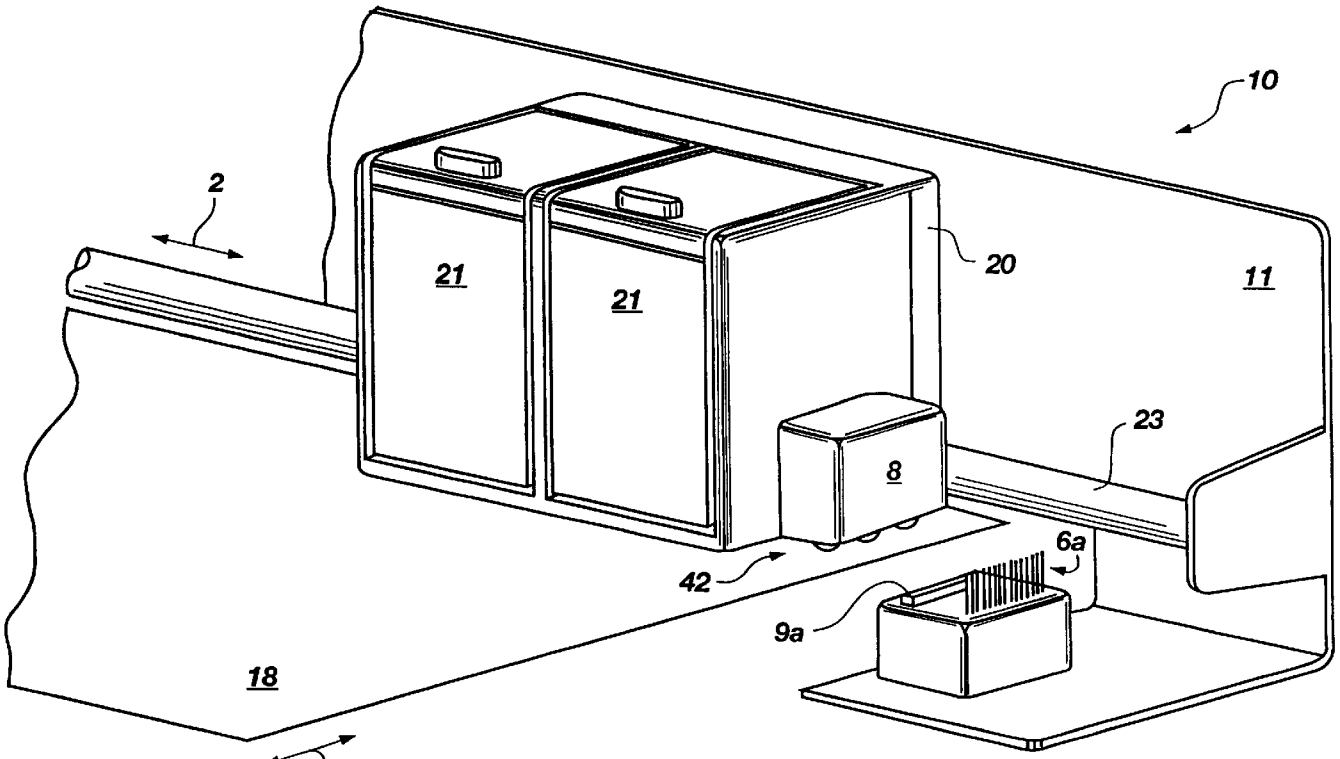
FIG. 4A is an isometric partial cutaway view of a movable optical apparatus and a fixed cleaning apparatus and heating apparatus usable with the printer of FIG. 1.
Figure 4B:
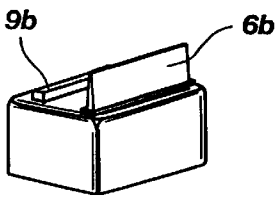
FIGS. 4B and 4C are alternative cleaning apparatuses usable with the printer of FIG. 4A.
Figure 4C:
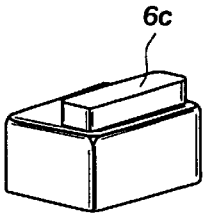

Considering now the cleaning apparatus 6 in further detail, and with reference to FIGS. 4A through 4C, the cleaning apparatus 6 can alternatively or in combination include a brush 6*a*; a wiper or scraper 6*b*; or a cleaning pad 6*c*. The brush 6a preferentially includes a number of cleaning bristles. A cleaning pad 6*d* preferentially includes a felt or cloth material, which in some embodiments may be chosen to have deposit-attracting cleaning properties. The cleaning elements 6*a–c* are brought into mechanical contact with the optical apparatus 8 in order to remove the deposits from the optical surface 42. The rigidity and deflectability of the different cleaning elements 6*a–c* varies with their structure and compositional material, and the appropriate one(s) are generally selected for use in a particular cleaning apparatus 6 based on, among other factors, the shape of the optical surface 42 to be cleaned, the scratch-resistiveness of the optical surface 42, and the type of deposits predominantly encountered. For example, a relatively flat optical surface 42 may be better cleaned by a wiper or scraper 6*b*, while a relatively uneven optical surface 42 may be better cleaned by a brush 6*a* or a pad 6*c*. In addition, a surface 42 made of a material which is more susceptive to scratching would be better cleaned by a brush 6*a* or a pad 6d rather than by a wiper or scraper 6*b*. While both the wiper 6*b* and the scraper 6*b* are preferably formed in the shape of a blade with a wider, triangular base and a narrower cleaning tip, a wiper 6*b* is typically fabricated from a more deflectable material such as rubber, while a scraper 6*b* is typically fabricated from a more rigid material having some springiness to maintain contact with the surface 42, such as stainless steel or hard plastic, which may provide greater cleaning action but have more of a tendency mar the finish of softer surfaces 42.

Figure 5:
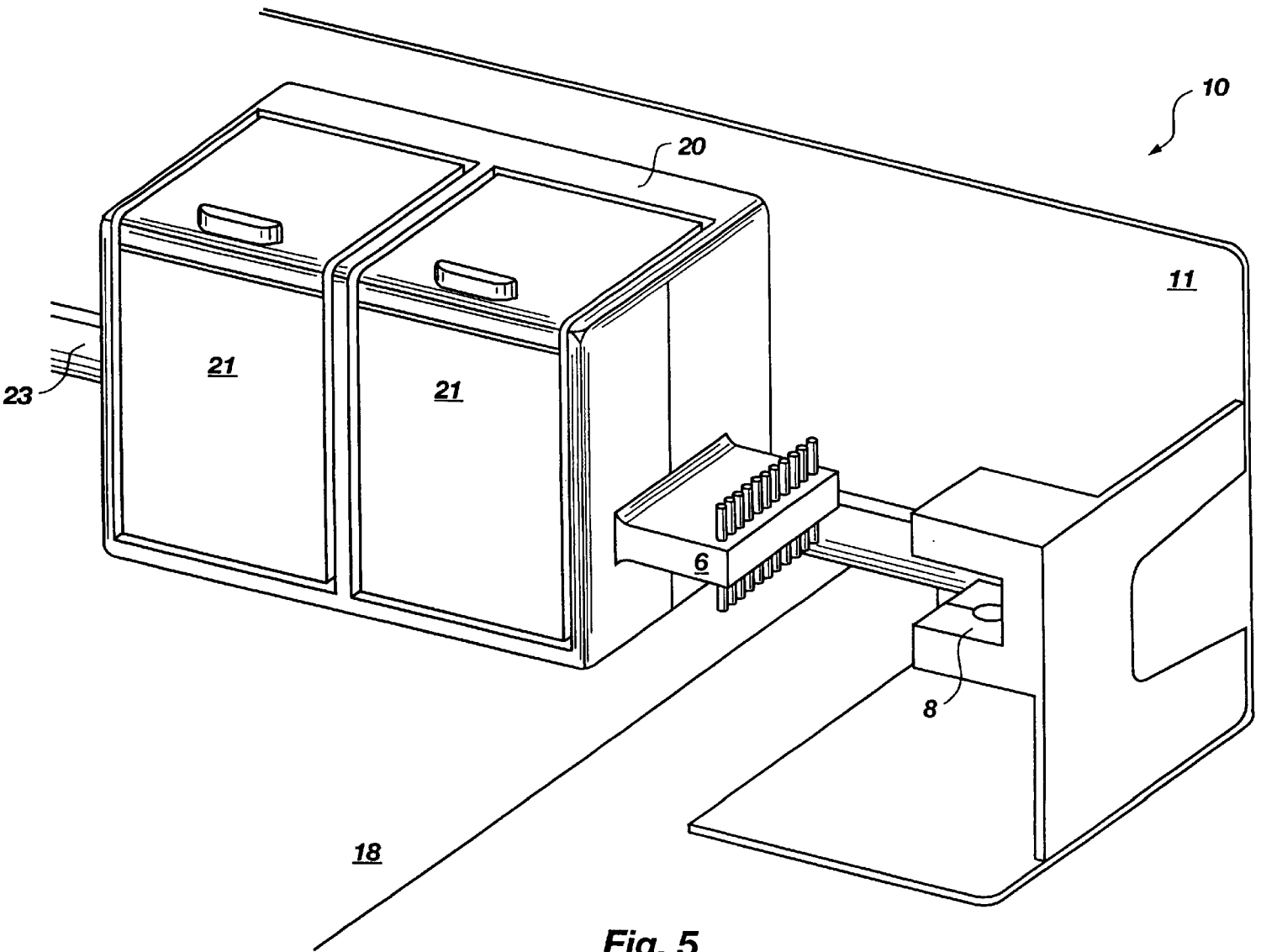
FIG. 5 is an isometric partial cutaway view of a movable cleaning apparatus and a fixed optical apparatus usable with the printer of FIG. 1.

Considering now the arrangement of the optical apparatus 8 and cleaning apparatus 6 within the printer 10, and with reference to FIGS. 4A and 5, one of the apparatuses 6,8 is preferentially attached to the carriage 20, while the other of the apparatuses 6,8 is fixedly attached to the frame 11. The one apparatus 6,8 which is attached to the carriage 20 becomes a movable element, while the other apparatus 6,8 which is attached to the frame 11 becomes a stationary element. In the exemplary configuration of FIG. 4A, the optical apparatus 8 is the movable element attached to the carriage 20, while the cleaning apparatus 6 is the stationary element attached to the frame 11. Conversely, and as illustrated by way of example in FIG. 5, the cleaning apparatus 6 is the movable element, while the optical apparatus 8 is the stationary element attached to the frame 11. During a cleaning operation of the printer 10, as the carriage 20 moves along the slider bar 23 in a direction along the scan axis 2, the movable element is brought into engagement with the stationary element by the movement of the carriage 20 so as to remove deposits from the optical surface 42 of the optical apparatus 8 as the cleaning apparatus 6 is wiped, scraped, or brushed against the optical surface 42. The cleaning apparatus 6 preferably traverses the entire optical surface 42, and as the direction of traversal along the scan axis is reversed, preferably traverses the entire optical surface 42 once again, this time in the opposite direction from the first traversal. In this way, deposits accumulated on the optical surface 42 are removed by the wiping, scraping, or brushing action, thus improving the transmissiveness of light through the optical surface 42 and the optical performance of the optical apparatus 8.

Figure 6A:
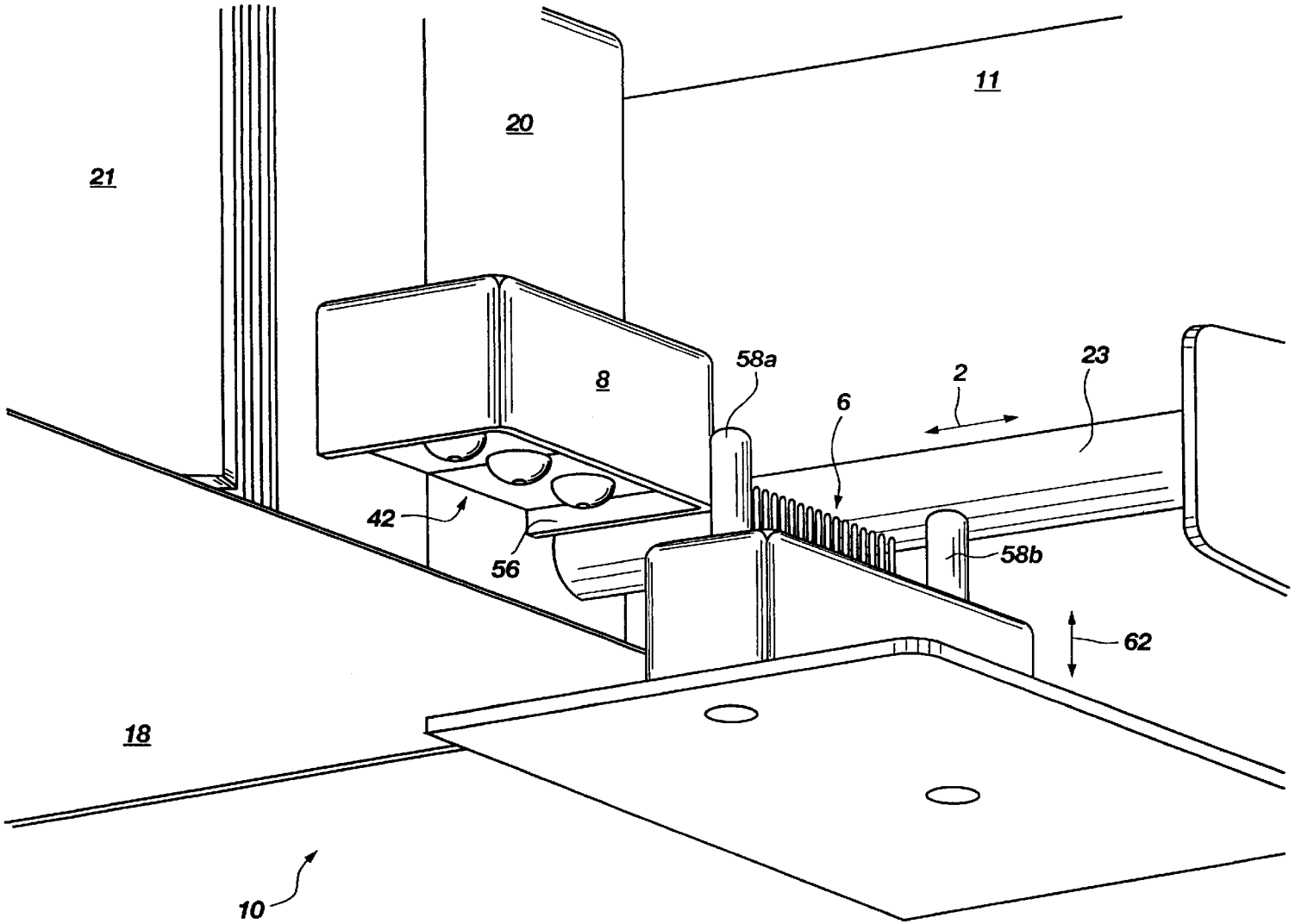
FIGS. 6A–C are isometric partial cutaway views of a movable cleaning apparatus and a movable optical apparatus usable with the printer of FIG. 1.
Figure 6B:
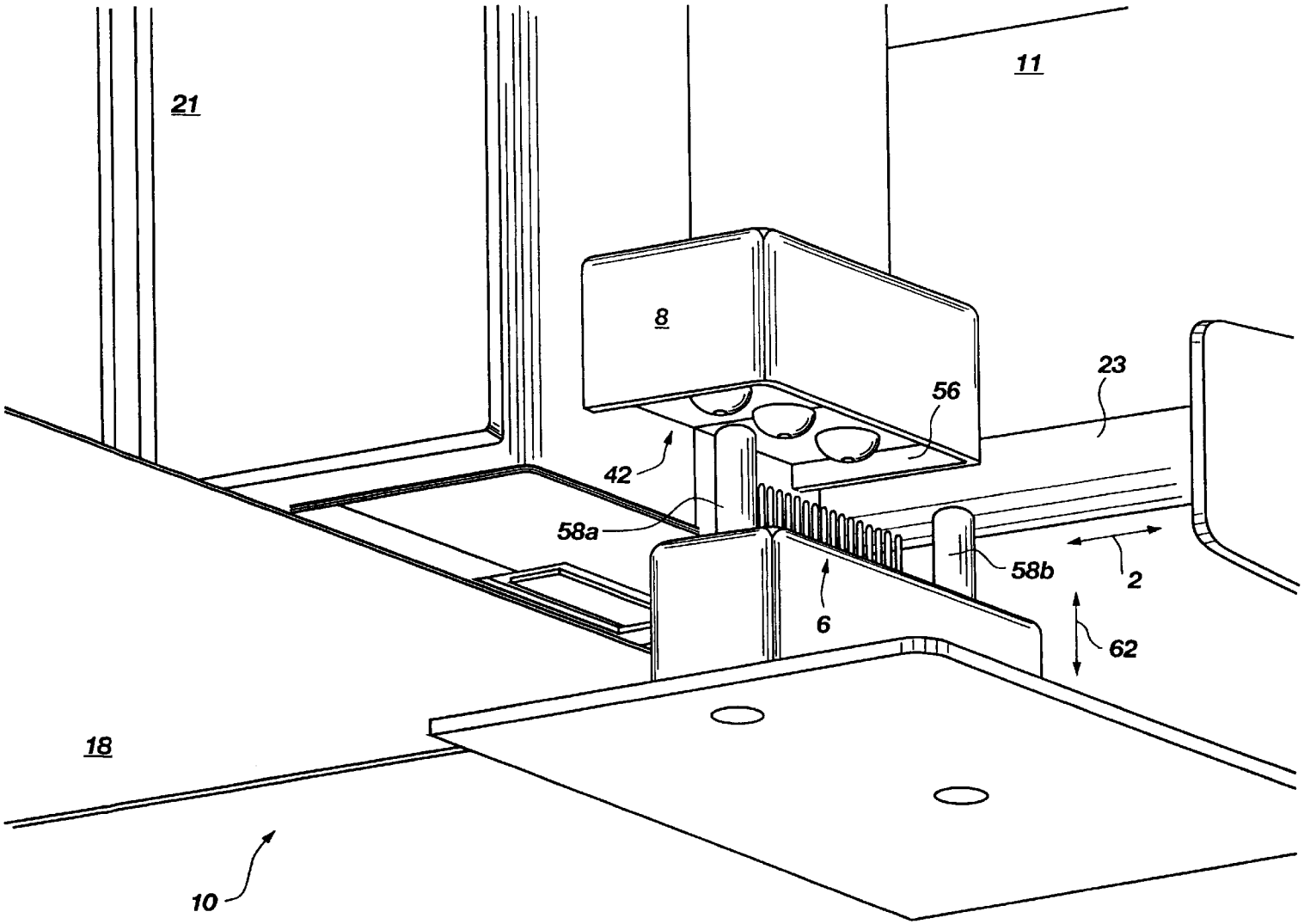
Figure 6C:
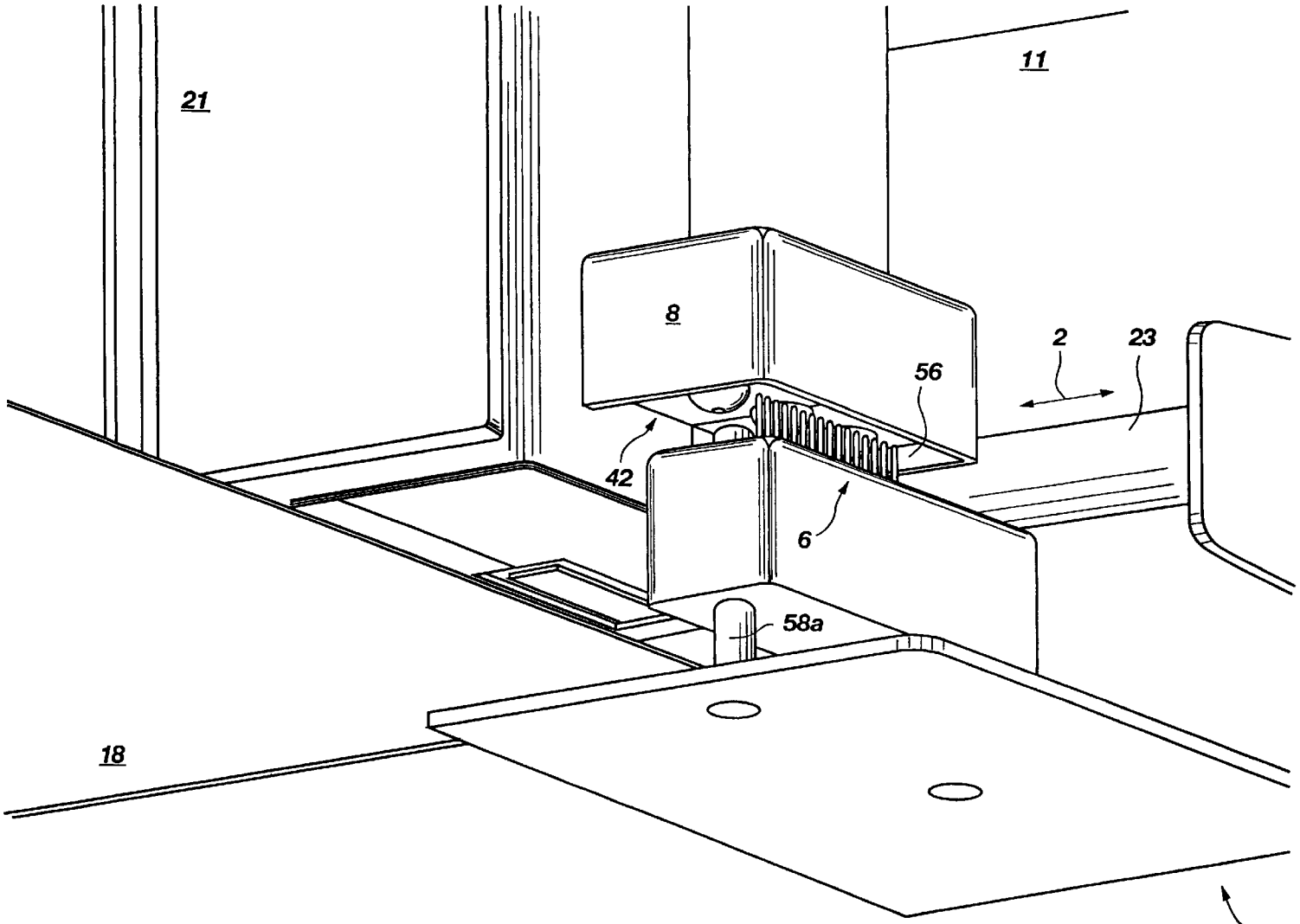
Figure 7:
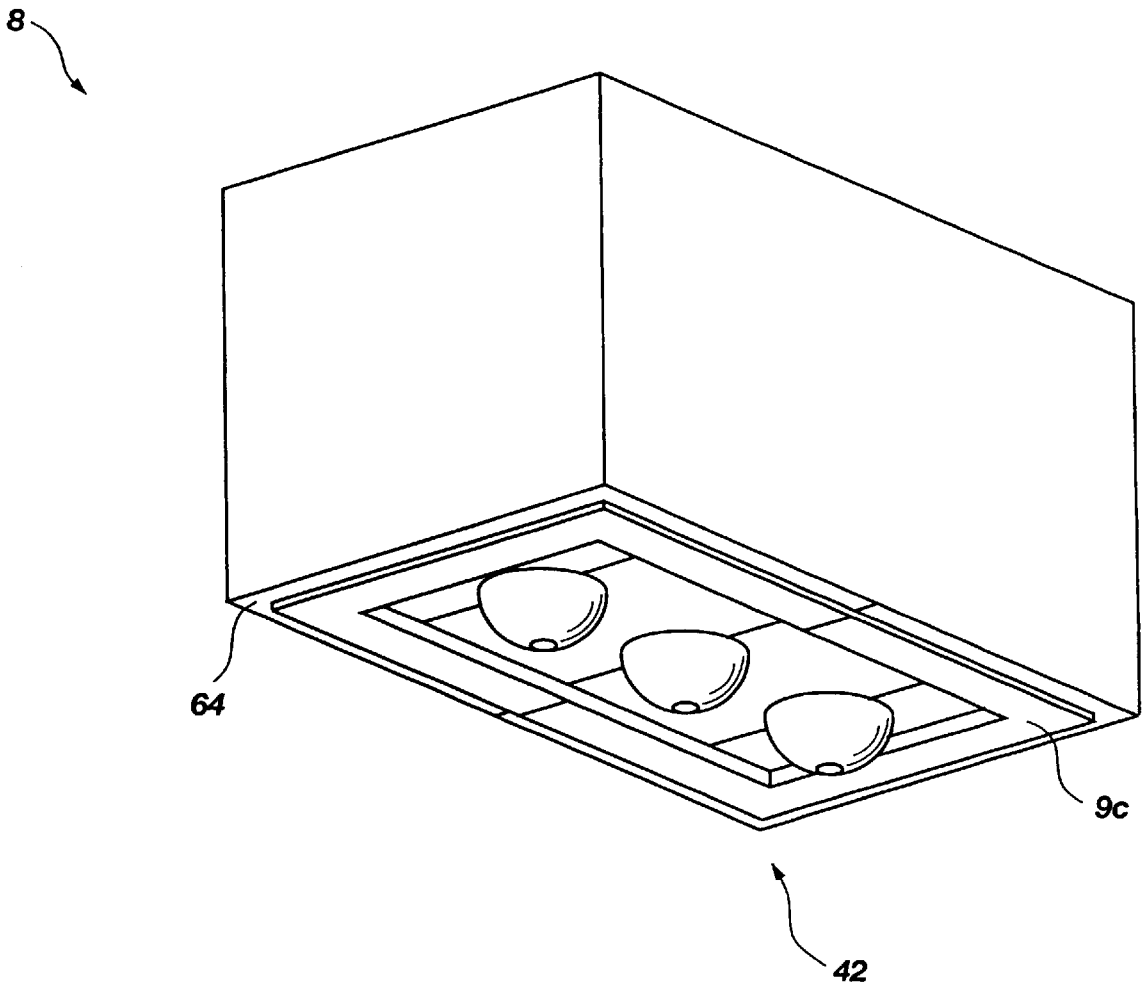
FIG. 7 is an isometric view of an optical apparatus including an embedded heater according to the present invention and usable with the printer of FIG. 1.
Figure 8:
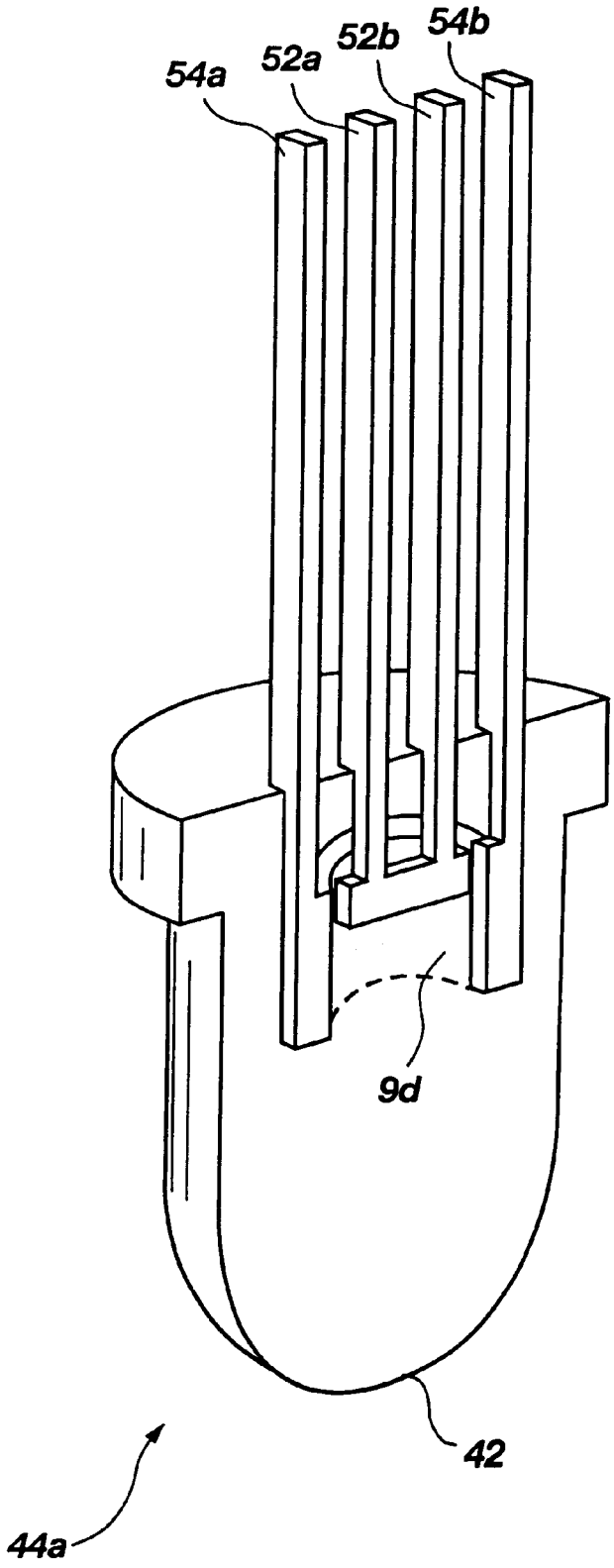
FIG. 8 is a schematic cutaway view of a light-emitting diode including an embedded heater according to the present invention and usable with the printer of FIG. 1.

In an alternate arrangement of the optical apparatus 8 and cleaning apparatus 6 within the printer 10, and as best understood with reference to the exemplary configuration of FIGS. 6A–6C, one of the apparatuses is attached to the carriage 20, such as the exemplary optical apparatus 8, while the other of the apparatuses, such as the exemplary cleaning apparatus 6, is movably attached to the frame 11. Such an arrangement is particularly useful where the optical surface 42 of the optical apparatus 8 is recessed within the optical apparatus 8, as may occur if the optical apparatus 8 includes sheathing 56 around the optical elements of the optical apparatus 8. Movement of the cleaning apparatus 6 to different positions along slider rods 58*a*, 58*b* is by conventional means known to those skilled in the art. The cleaning apparatus 6 is sized to fit within the recess defined by the optical surface 42 and the sheathing 56, and the axis of movement 62 of the cleaning apparatus 6 is into this recess so as to contact the optical surface 42. The print controller 50 coordinates the movement of the carriage 20 along the scan axis 2 and the movements of the cleaning apparatus 6 along axis 62 so as to engage the cleaning apparatus 6 with the optical surface 42 and remove the deposits.

Considering now in further detail the heating apparatus 9, and with reference to FIGS. 4A, 4B, 7, and 8, the heating apparatus 9 is used in the presently preferred embodiment to dry deposits which have a moistness, such as stray aerosol ink drops, on the optical surface 42 prior to removing these deposits. Drying moist or wet deposits before or during removal advantageously makes removal of these deposits by the mechanical contact between the cleaning apparatus 6 and the optical surface 42 of the optical apparatus 8 easier and more complete.

The heating apparatus 9 may be external to the optical apparatus 8. Such an external heating apparatus may include a heat source 9*a*, a light source 9*b*, or the like. The external heating apparatus can be mounted either on the frame 11 or on the carriage 20. The external heating apparatus 9 is preferentially mounted proximate the cleaning apparatus 6 (which, as explained heretofore, can also be mounted either on the frame 11 or on the carriage 20), and periodically positioned proximate the optical apparatus 8 during a drying operation which occurs prior to or during the cleaning operation so as to be in thermal communication with the optical surface 42 in order to cause drying to occur. Alternatively, the external heating apparatus 9 may be mounted proximate the optical apparatus 8, so that the drying operation can take place intermittently or continuously during printer operation.

The heating apparatus 9 may alternatively be formed as an internal heating element integral to the optical apparatus 8 itself. Such an internal heating element may include a heater coil 9*c* mounted on or within the optical apparatus 8 in thermal communication with the optical surface 42 so as to cause drying of deposits to occur. The internal heating element may be disposed around the perimeter 64 of the optical surface 42, or may be formed in any of a variety of other shapes to fit the optical apparatus 8 so long as thermal communication with the surface 42 can occur during heating. The internal heating element may alternatively include a resistive heating element 9*d* fabricated as part of an optical element such as an LED 44*a* or optical sensor 46 and in thermal communication with the optical surface 42 so as to cause drying to occur. In a preferred embodiment, the resistive heating element 9*d* is fabricated in a generally cylindrical shape and disposed within the LED 44*a* or optical sensor 46. The heater coil 9*c* or resistive heating element 9*d* is responsive to a heater control signal, typically an electrical current sufficient to generate joule or resistive heating, supplied to heater leads 54*a*, 54*b* of the optical element or optical apparatus 8 by the print controller 50 or another component, such as a power supply (not shown) of the printer 10. Alternatively, for some types of optical elements such as the LED 44*a*, a different-than-normal operating signal, such as a higher-than-normal voltage or current, applied to the optical-operation leads 52*a*, 52*b* of the optical apparatus 8 can also generate joule heating sufficient to dry the deposits on the adjacent optical surface 42.

As previously mentioned, and as best understood with reference to FIG. 9, the present invention may also be implemented as a novel method 100 for removing deposits from a surface 42 of an optical apparatus 8 of a printer 10. The method 100 provides at 102 a cleaning apparatus 6 disposed in the printer 10 for relative motion with respect to the optical apparatus 8. At 104, a heating apparatus 9 disposed in the printer 10 in proximity to an optical surface 42 of the optical apparatus 8 sufficient to allow thermal communication with the surface 42 is provided. At 106, the optical surface is preferably heated to dry any deposits on it, including but not limited to stray aerosol ink droplets, print medium particles including paper dust, or particles from the environmental in which the printer 10 is operated. At 108, the cleaning apparatus 6 is engaged with the optical surface 42. During the engagement, at 110, the deposits are removed from the optical surface by wiping, scraping, or brushing (as appropriate for the particular cleaning apparatus 6) the cleaning apparatus 6 against the optical surface 42.

Figure 10:
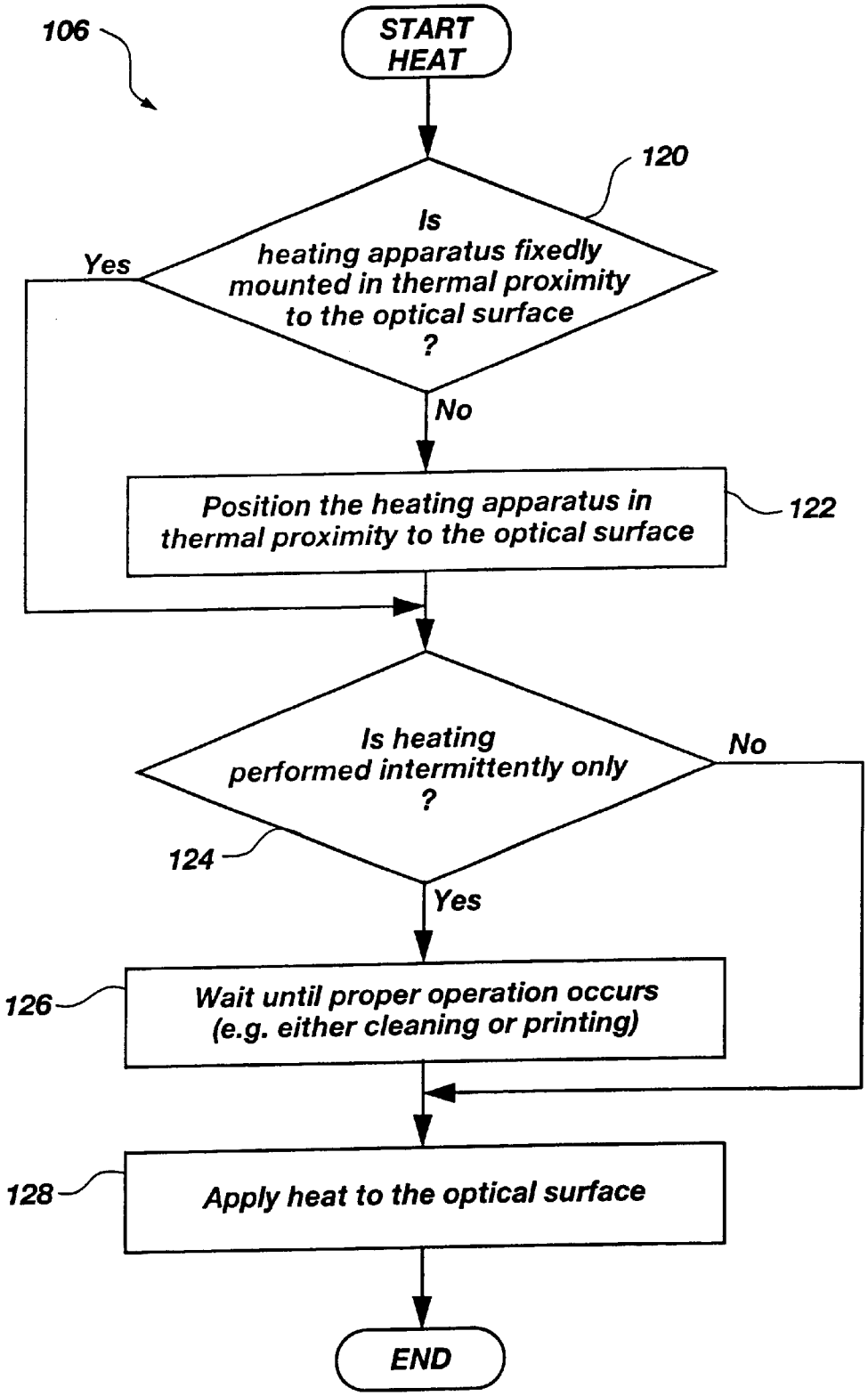
FIG. 10 is a more detailed flowchart of heating the optical surface according to FIG. 9.
Figure 13A:
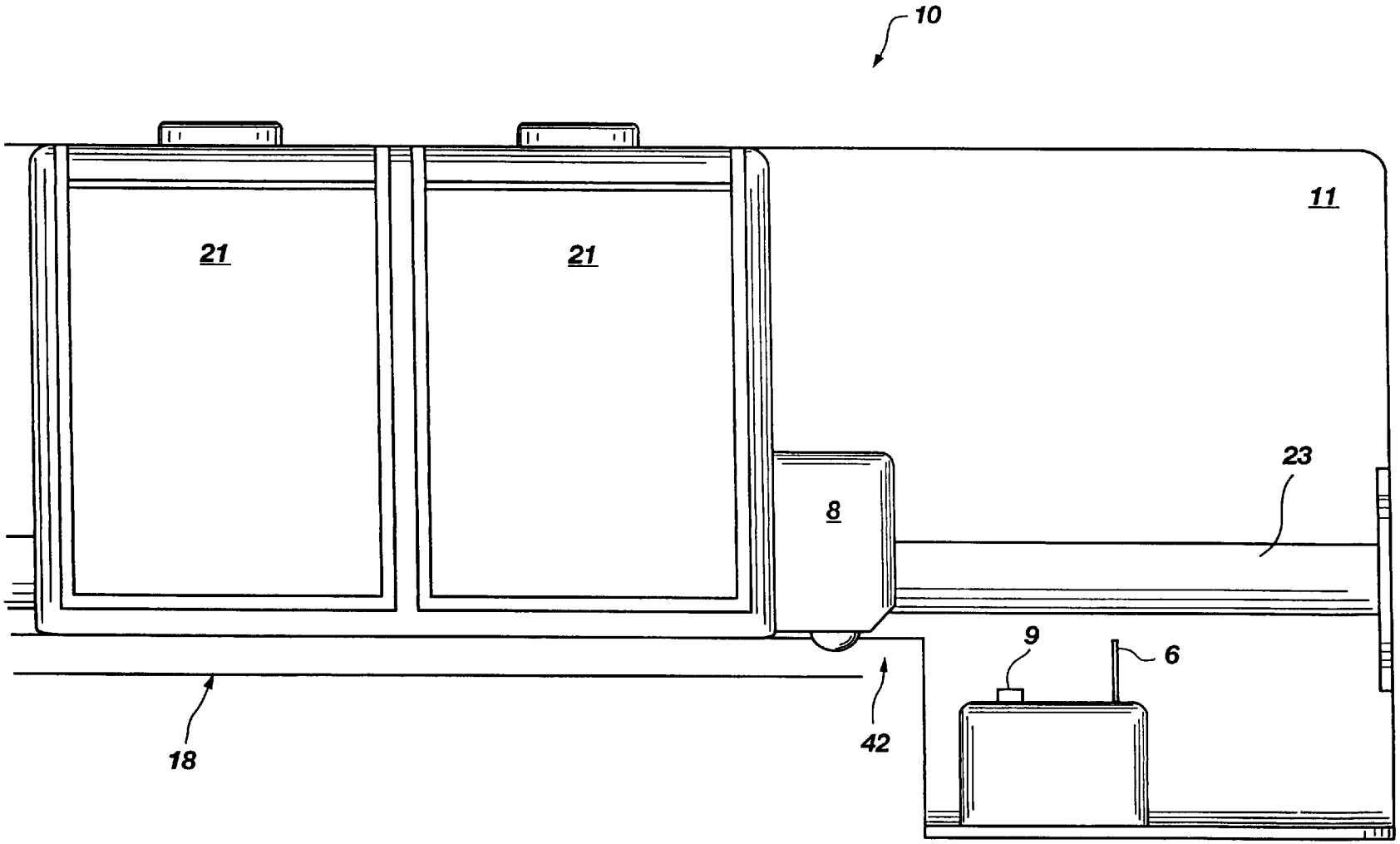
FIGS. 13A–D are frontal views of the printer of FIG. 4A showing the relative positionings of the heating apparatus, cleaning apparatus, and optical apparatus during a cleaning operation.
Figure 13B:
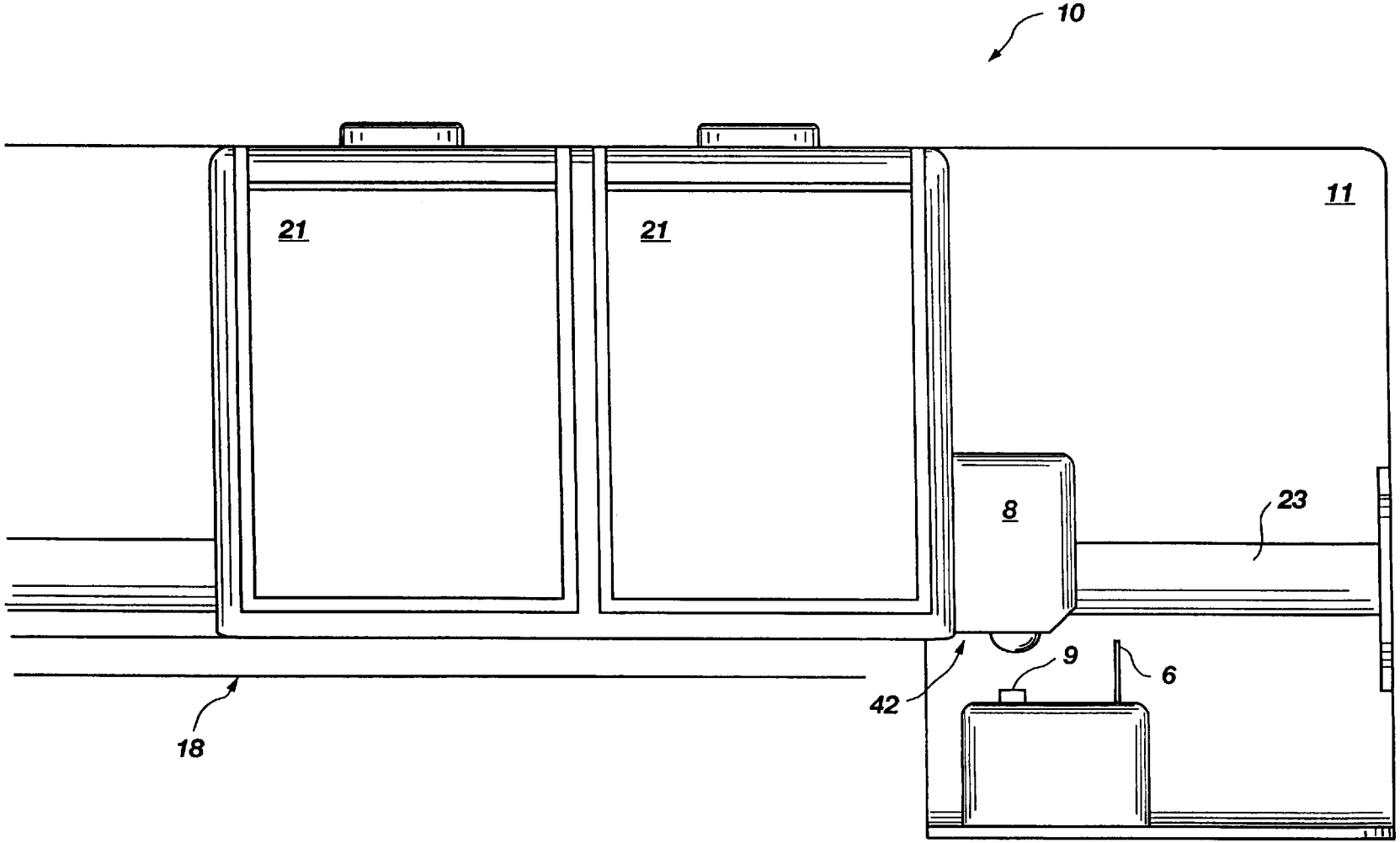
Figure 13C:
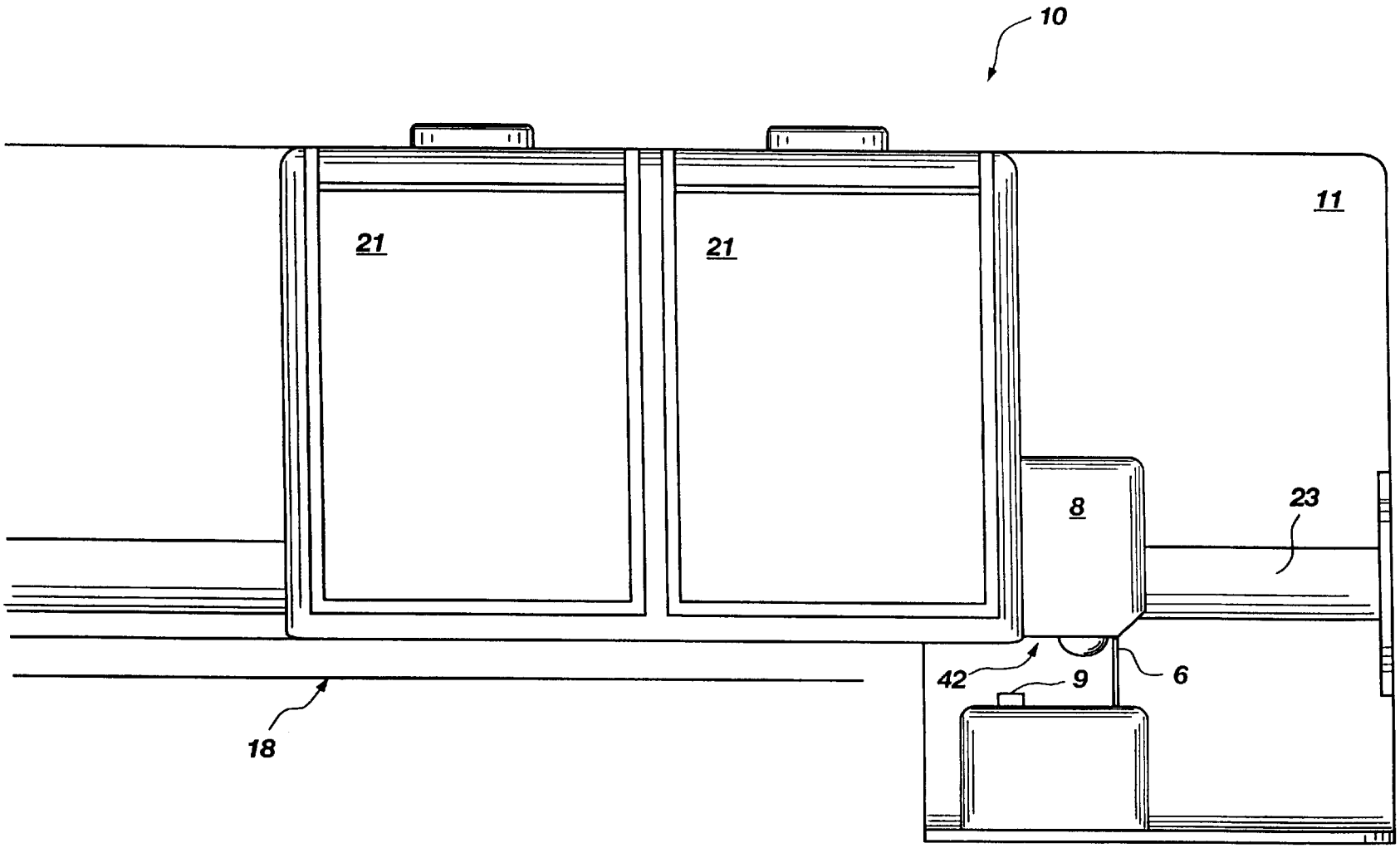
Figure 13D:
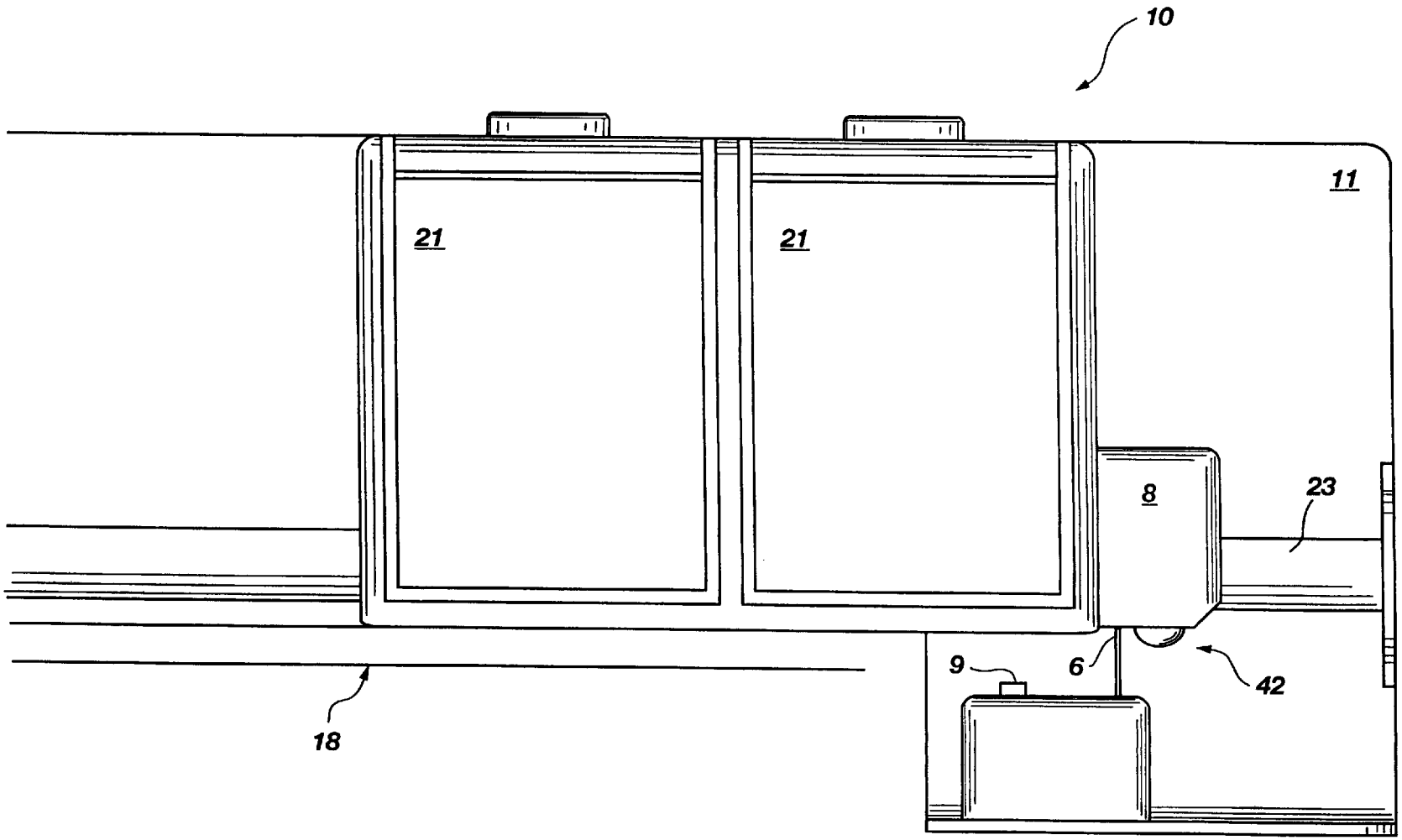

Considering now in further detail the heating 106, and with reference to FIG. 10, if the heating apparatus 9 is not fixedly mounted in thermal proximity to the optical surface 42 (as illustrated in the exemplary printer of FIG. 13A) but rather is intermittently positionable near the surface 42 ("No" branch of 120), then at 122 the heating apparatus 9 is moved to a position (as illustrated in the exemplary printer 10 of FIG. 13B) where it comes into thermal communication with the optical surface 42. Conversely, if the heating apparatus 9 is fixedly mounted in thermal proximity to the optical surface 42 ("Yes" branch of 120), then the positioning of 122 is not performed. If heating is not continuous but is rather performed only intermittently ("Yes" branch of 124), then at 126 the method waits until the proper operating mode begins. The proper operating mode may be the start of a printing operation (before which, for example, the printer was idle), or the start of a cleaning operation (where the cleaning operation is performed at a time separate from a printing operation). Once the proper operating mode starts, or if heating is continuous ("No" branch of 124), then at 128 heat is applied to the optical surface 42.

Figure 11:
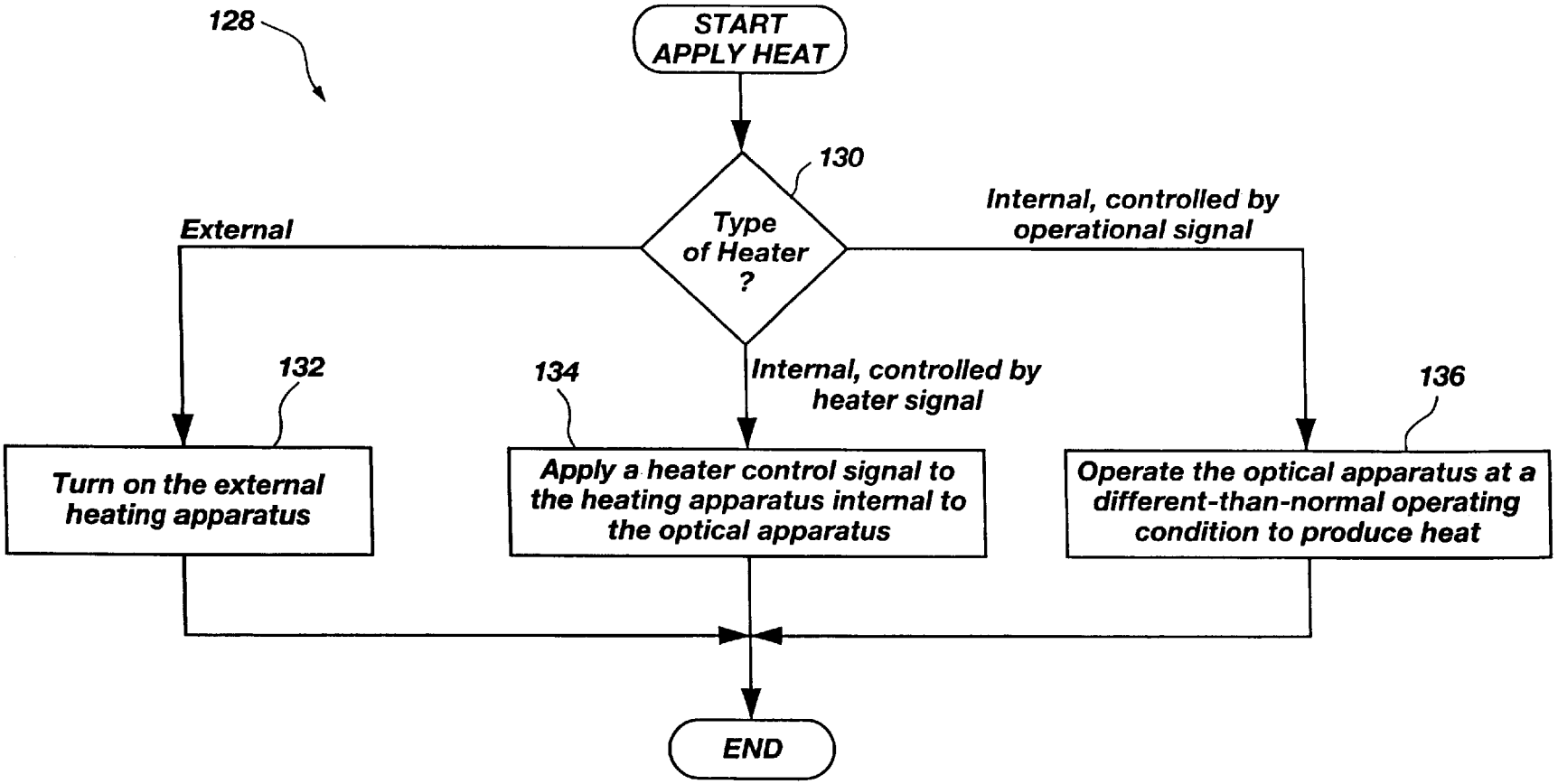
FIG. 11 is a more detailed flowchart of applying heat to the optical surface according to FIG. 10.

Considering now in further detail the application of heat 128, and with reference to FIG. 11, the manner in which heat is applied depends on the type of heat source. If the heating apparatus 9 is external to the optical apparatus 8, then the external heat source is turned on at 132. If the heating apparatus 9 is internal to the optical apparatus 8 and is controlled by a separate heater control signal, then at 134 this heater control signal is applied to the internal heating source. If heating apparatus 9 is internal to the optical apparatus 8 but is instead controlled by a different-than-normal operating signal, then at 136 this different-than-normal operating signal is applied to the optical apparatus 8. This different-than-normal operating signal is preferentially a higher-than-normal voltage or current that will produce joule heating in the optical apparatus 8.

Figure 12:
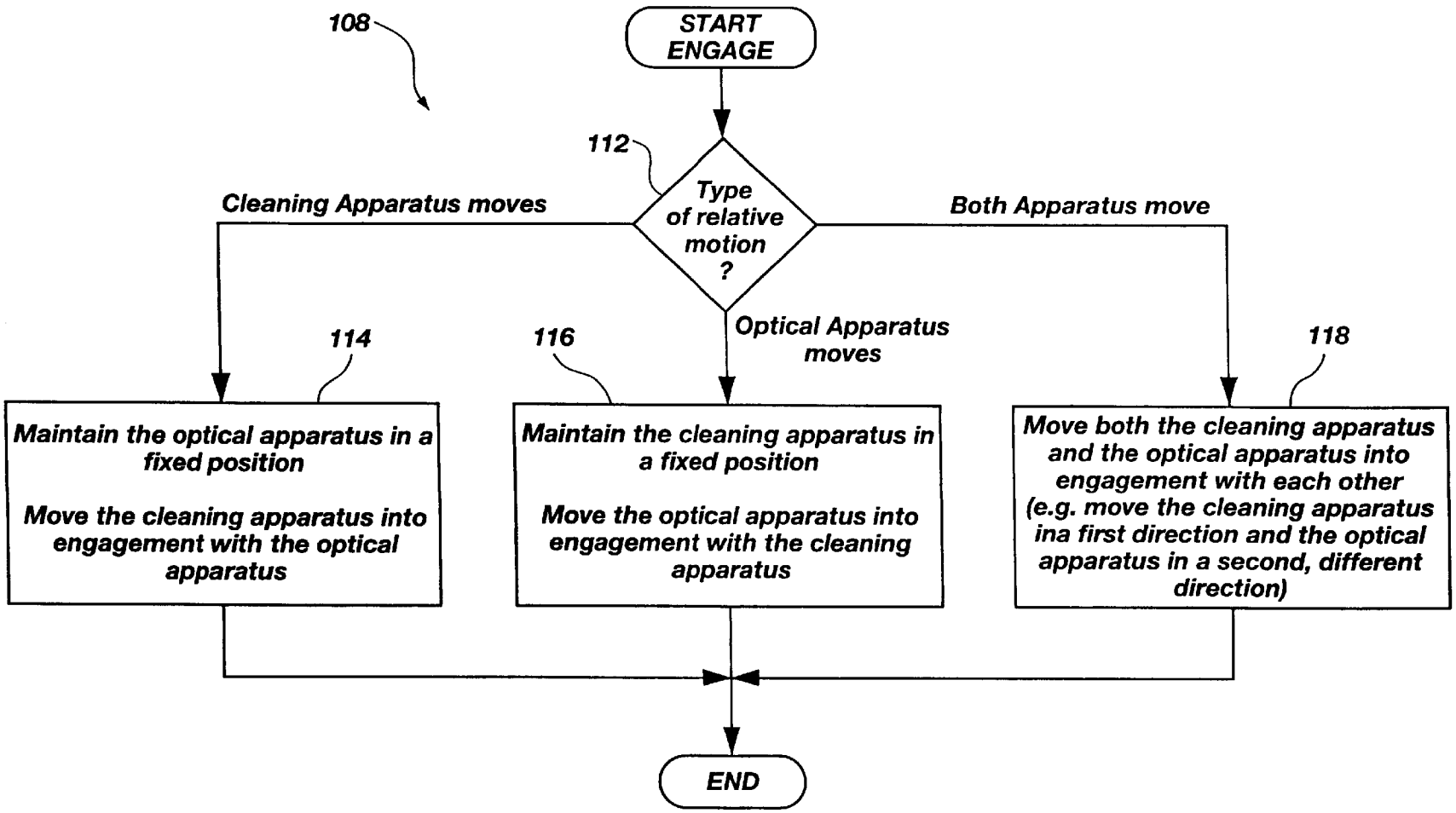
FIG. 12 is a more detailed flowchart of engaging the cleaning apparatus with the optical apparatus according to FIG. 9.

Considering now in further detail the engagement 108, and with reference to FIG. 12, the manner of engagement depends on the type of relative motion of the cleaning apparatus 6 and the optical apparatus 8 provided by the printer 10. In a first printer 10 configuration, as best understood with reference to FIGS. 4A, 13A, 13C, and 13D, in which the cleaning apparatus 6 is fixed and the optical apparatus 8 moves, the optical apparatus 8 is moved into engagement with the cleaning apparatus 6 so as to draw the cleaning apparatus across the optical surface 42. In a second printer 10 configuration, as best understood with reference to FIG. 5, the cleaning apparatus 6 is moved into engagement with the optical apparatus 8 so as to draw the cleaning apparatus across the optical surface 42. In a third printer 10 configuration, as best understood with reference to FIGS. 6A, 6B, and 6C, both the cleaning apparatus 6 and the optical apparatus 8 are moved into engagement with each other so as to draw the cleaning apparatus across the optical surface 42. The optical apparatus is typically moved along a first axis, such as the scan axis 2, while the cleaning apparatus is moved along a second axis, such as axis 62; these movements are coordinated by the print controller 50 in a manner which allows the optical surface 42, such as a surface 42 obstructed by optical apparatus sheathing 56, to be effectively cleaned.

From the foregoing it will be appreciated that the optical apparatus cleaning system and method provided by the present invention represent a significant advance in the art. By effectively and reliably cleaning undesirable deposits from optical surfaces in a printer, the present invention maintains a high level of printing quality without the need for costly and inconvenient printer repairs. Although several specific embodiments of the invention have been described and illustrated, the invention is not limited to the specific methods, forms, or arrangements of parts so described and illustrated. The invention is limited only by the claims.

What is claimed is:

1. A method of removing deposits from an optical apparatus of a printer, said optical apparatus having a surface including at least one of a light source, an optical sensor, and a light-transmissive element, the light-transmissive element for at least one of passing light having a predetermined amount of scattering therethrough, focusing light thereby, and collecting light thereby, said method comprising:

providing a cleaning apparatus disposed in the printer for relative motion with respect to the optical apparatus;

maintaining the optical apparatus in a fixed position in the printer;

engaging the cleaning apparatus with at least a portion of the surface of the optical apparatus by moving the cleaning apparatus into engagement with at last a portion of the surface of the optical apparatus; and removing the deposits from at least a portion of the surface of the optical apparatus during the engaging.

2. The method of claim 1, wherein the maintaining includes maintaining the cleaning apparatus in the fixed position, and the engaging includes moving the optical apparatus into engagement with the cleaning apparatus.

3. The method of claim 1, wherein the removing includes:

scraping the cleaning apparatus against the optical apparatus to remove the deposits.

4. The method of claim 1, wherein the removing includes:

brushing the deposits from the optical apparatus with the cleaning apparatus.

5. The method of claim 1, wherein the removing includes: wiping the deposits from the optical apparatus with the cleaning apparatus.

6. A method of removing deposits having a moistness from an optical apparatus of an inkjet printer, said optical apparatus having a surface including at least one of a light source, an optical sensor, and a light-transmissive element, said light-transmissive element for at least one of passing light having a predetermined amount of scattering therethrough, focusing light thereby, and collecting light thereby, said method comprising:

providing a cleaning apparatus disposed in the inkjet printer for relative motion with respect to the surface of the optical apparatus;

heating the optical apparatus to eliminate the moistness from the deposits;

engaging of the cleaning apparatus with at least a portion of the surface of the optical apparatus; and removing the deposits from at least a portion of the surface of the optical apparatus during heating apparatus as part of an optical element of the optical apparatus.

7. The method of claim 6, wherein the heating is performed intermittently during a cleaning operation of the printer.

8. The method of claim 6, wherein the heating is performed continuously during a printing operation of the printer.

9. The method of claim 6, wherein the heating includes applying a different-than-normal operating signal to the optical apparatus in order to produce the heating.

10. The method of claim 6, wherein the heating includes positioning a heating apparatus in thermal proximity to the optical apparatus.

11. The method of claim 10, wherein the positioning includes intermittently positioning the heating apparatus in thermal proximity to the optical apparatus.

12. The method of claim 10, wherein the positioning includes fixedly mounting the heating apparatus in thermal proximity to the optical apparatus.

13. The method of claim 10, wherein the positioning includes fabricating the heating apparatus as part of an optical element of the optical apparatus.

14. The method of claim 10, wherein the engaging and removing are performed during a cleaning operation.

15. The method of claim 14, wherein the cleaning operation is included in a printing operation.

16. The method of claim 14, wherein the cleaning operation is separate from a printing operation.

17. The method of claim 1, wherein the printer is an inkjet printer and the deposits are aerosol ink droplets.

18. The method of claim 1, wherein the printer prints on a print medium and the deposits are dust particles from the print medium.

19. The method of claim 1, wherein the printer is located in a printing environment and the deposits are particles from the printing environment.

20. A cleaning system for a printer, comprising:

a fixed optical apparatus disposed in the printer, the optical apparatus degradable by deposits on an optical surface of the optical apparatus, the fixed optical apparatus including at least one of a light source, an optical sensor, and a light-transmissive element, said light-transmissive element for at least one of passing light having a predetermined amount of scattering therethrough, focusing light thereby, and collecting light thereby; and a cleaning apparatus disposed in the printer for relative motion with respect to the fixed optical apparatus, the cleaning apparatus mechanically engageable with at least a portion of the optical surface of the optical apparatus during a cleaning operation of the printer so as to remove the deposits from the optical surface of the optical apparatus.

21. The cleaning system of claim 20, wherein the cleaning apparatus includes a scraper.

22. The cleaning system of claim 20, wherein the cleaning apparatus includes a wiper.

23. The cleaning system of claim 20, wherein the cleaning apparatus includes a brush.

24. The cleaning system of claim 20, wherein the light source is a light-emitting diode.

25. The cleaning system of claim 20, wherein the light-transmissive element is a lens.

26. The cleaning system of claim 20, wherein the optical sensor is a sensing element selected from the group consisting of a photodiode and a phototransistor.

27. A cleaning system for a printer, comprising: an optical apparatus disposed in the printer, the optical apparatus degradable by deposits on an optical surface of the optical apparatus, the deposits having a moistness, the optical apparatus including at least one of a light source, an optical sensor, and a light-transmissive element, said light-transmissive element for at least one of passing light having a predetermined amount of scattering therethrough, focusing light thereby, and collecting light thereby;

a heating apparatus disposed in the printer for drying the deposits on the optical surface so as to reduce the moistness; and a cleaning apparatus disposed in the printer for relative motion with respect to the optical apparatus, the cleaning apparatus mechanically engageable with the optical surface of the optical apparatus during a cleaning operation of the printer so as to remove the dried deposits from the optical surface of the optical apparatus.

28. The cleaning system of claim 27, wherein the heating apparatus is selected from a group consisting of a heat source and a light source.

29. The cleaning system of claim 28, wherein the heating apparatus is disposed in the printer in thermal proximity to the optical apparatus.

30. The cleaning system of claim 29, wherein the heating apparatus is positionable in thermal proximity to the optical apparatus during an operation of the printer.

31. The cleaning system of claim 28, wherein the heating apparatus is a heating element incorporated into the optical apparatus.

32. The cleaning system of claim 31, wherein the heating element is a resistive heating element.

33. The cleaning system of claim 31, wherein the resistive heating element is responsive to a higher-than-normal operating signal supplied to the optical apparatus.

34. The cleaning system of claim 33, wherein the higher-than-normal operating signal is provided to the resistive heating element by a print controller disposed in the printer and electrically connected to the optical apparatus.

35. The cleaning system of claim 32, wherein the resistive heating element is responsive to a heater control signal supplied to the optical apparatus.

36. The cleaning system of claim 35, wherein the heater control signal is provided to the resistive heating element by a print controller disposed in the printer and electrically connected to the optical apparatus.

37. The cleaning system of claim 32, wherein the heating element is disposed around a perimeter of the optical surface.

38. The cleaning system of claim 32, wherein the heating element is disposed within the optical apparatus in thermal communication with the optical surface.

39. The cleaning system of claim 27, wherein the optical apparatus includes a light-emitting diode, and wherein the heating apparatus is the light-emitting diode.

40. The cleaning system of claim 39, wherein heating is produced by applying to the LED a higher/different-than-normal operating signal.

41. The cleaning system of claim 39, wherein heating is produced by applying to the LED a heater control signal separate from the operating signal.

42. An inkjet printer, comprising:

a frame;

a stationary element attached to the frame, the stationary element having an optical apparatus connected thereto;

a carriage movably mounted to the frame for movement along a scan axis, the carriage having a cleaning apparatus connected thereto;

a movable element attached to the carriage such that the movable element mechanically engages the stationary element during movement of the carriage along the scan axis so as to remove deposits from a surface of an optical apparatus during an automatic cleaning operation of the printer.

43. The inkjet printer of claim 42, further including a heating apparatus attached to the frame to dry the deposits on the surface of the optical apparatus.

44. The inkjet printer of claim 42, further including a heating apparatus attached to the carriage to dry the deposits on the surface of the optical apparatus before removal.

45. The inkjet printer of claim 42, further including a heating apparatus integral to the optical apparatus to dry the deposits thereon.

* * * * *